US006224109B1

(12) United States Patent
Yang

(10) Patent No.: US 6,224,109 B1
(45) Date of Patent: May 1, 2001

(54) CREDIT CARD WITH DRIVER'S LICENSE OR IDENTIFICATION

(76) Inventor: James Yung Chien Yang, 1212 Nuuana Avenue, #2008, Honolulu, HI (US) 96817

( * ) Notice: Subject to any disclaimer, the term of this patent is extended or adjusted under 35 U.S.C. 154(b) by 0 days.

(21) Appl. No.: 09/370,617

(22) Filed: Aug. 7, 1999

(51) Int. Cl.[7] ..... B42D 15/00

(52) U.S. Cl. ..... 283/77; 283/70; 283/73; 283/83; 283/57; 40/625

(58) Field of Search ..... 283/70, 73, 83, 283/57; 40/625

(56) References Cited

U.S. PATENT DOCUMENTS

| | | | | |
|---|---|---|---|---|
| 3,571,957 | | 3/1971 | Cumming . | |
| 4,318,554 | | 3/1982 | Anderson et al. . | |
| 5,459,304 | | 10/1995 | Eisenmann . | |
| 5,642,160 | * | 6/1997 | Bennett | 348/156 |
| 5,787,186 | | 7/1998 | Schroeder . | |
| 5,841,886 | * | 11/1998 | Rhoads | 382/115 |
| 5,886,334 | * | 3/1999 | D'entremont et al. | 235/380 |
| 5,900,954 | * | 5/1999 | Katz et al. | 359/2 |
| 5,952,941 | * | 9/1999 | Mardirossian | 340/936 |
| 5,984,366 | * | 11/1999 | Priddy | 283/72 |
| 6,016,484 | * | 1/2000 | Williams et al. | 705/39 |
| 6,042,005 | * | 3/2000 | Basile et al. | 235/382 |
| 6,052,068 | * | 4/2000 | Price R-W et al. | 340/933 |
| 6,085,976 | * | 7/2000 | Sehr | 235/384 |

* cited by examiner

*Primary Examiner*—A. L. Wellington
*Assistant Examiner*—Alisa L. Thurston
(74) *Attorney, Agent, or Firm*—Michael I. Kroll

(57) ABSTRACT

A credit card with driver's license for providing credit to an individual, information regarding the individual and proof of registration to operate a motor vehicle on a single form of identification. The credit card with driver's license includes a semi rigid thin piece of material having a face side, a photograph of the individual positioned on the face side, additional identifying information positioned on the face side and a magnetic strip storing information providing access to credit of the individual and personal information regarding the individual upon reading of said magnetic strip by a credit card terminal. The credit card with driver's license is registered with a department of motor vehicles in a state in which the owner resides and credit is provided by either an independent financial institution or the state government issuing the driver's license. The additional information includes at least one of a date of birth, height, weight, hair color, eye color, sex and an address of the owner printed on said face side. The credit card with driver's license may be laminated to provide additional protection against altering information thereon. A strip is also positioned on a back side thereof within which the individual places a signature for purposes of authentication when accessing credit provided by said credit card with driver's license.

6 Claims, 4 Drawing Sheets

CREDIT CARD WITH DRIVER'S LICENSE OR IDENTIFICATION

BACKGROUND OF THE INVENTION

1. Field of the Invention

The present invention relates generally to identification cards and, more specifically, to a driver's license providing credit capabilities thus functioning as both an instrument of credit while also providing identification information regarding the owner of the card and illustrating the owner is licensed to operate a motor vehicle.

2. Description of the Prior Art

Numerous types of identification cards have been provided in the prior art. For example, U.S. Pat. Nos. 3,571,957; 4,318,554; 5,459,304 and 5,787,186 all are illustrative of such prior art. While these units may be suitable for the particular purpose to which they address, they would not be as suitable for the purposes of the present invention as heretofore described.

U.S. Pat. No. 3,571,957

Inventor: Peter N. Cumming, et al.

issued: Mar. 23, 1971

A credit card or other identification document as issued to the owner named thereon having as a permanent part thereof a micronegative containing normally unreadable identifying indicia of the owner of the card or document and a viewer capable of enlarging the indicia on the negative sufficiently to produce a readable identification of the owner of the card or document.

U.S. Pat. No. 4,318,554

Inventor: Thomas P. Anderson et al.

Issued: Mar. 9, 1982

A medical and/or informational identification credit card has multiple laminar parts partially heat-sealed in a localized area to permit high speed embossment in automatic equipment, whereupon a customized informational part, such as a microfilm chip or photograph, matched to the embossed identification on the partially laminated card may be inserted and locked in place by a full lamination of the card.

U.S. Pat. No. 5,459,304

Inventor: Jeffrey J. Eisenmann

Issued: Oct. 17, 1995

Smart card techniques are disclosed for integrating and administering records related to the ownership and/or operation of motor vehicles. A smart identification card stores and administers a plurality of motor vehicle records corresponding to a single motorist. These motor vehicle records include items selected from the group of motor vehicle registration information, drivers license information, vehicle code violations, automobile insurance information, parking garage entry times, parking garage account balance, highway toll account balance, motor club information, and environmental inspection information. Each smart identification card is equipped to interact with any of a plurality of computer databases through the utilization of a conventional communications link in conjunction with a smart card scanner. Each of the computer databases administers motor vehicle records.

U.S. Pat. No. 5,787,186

Inventor: Carlos Cobian Schroeder

Issued: Jul. 28, 1998

A biometric security procedure for manufacturing an identity document, such as an identity card, credit card, visa or passport, which includes the steps of: providing a nucleus of the identity document, the nucleus including personal data of a holder of the identity document and a face image of the holder; carrying out, by a computer and an image capturer such as a scanner or a video camera, an analysis of face features of the face image. The computer carrying out an analysis of basic face features of the face image, comparing the basic face features with master/pattern features in a data base, wherein each master/pattern feature has a specific number; obtaining by the analysis a derived set of master/pattern features that corresponds to a characteristic synthetic image of the holder, the derived set of master/pattern features corresponding to a specific numeric code determined by the number of each of the master/pattern features making up the derived set of master/pattern features; and printing the specific numeric code by a printer connected to the computer, on an area of the identity document defined as a code window, whereby the specific numeric code univocally characterizes the holder of the identity document.

SUMMARY OF THE PRESENT INVENTION

The present invention relates generally to identification cards and, more specifically, to a driver's license providing credit capabilities thus functioning as both an instrument of credit while also providing identification information regarding the owner of the card and illustrating the owner is licensed to operate a motor vehicle.

A primary object of the present invention is to provide a credit card with driver's license that will overcome the shortcomings of prior art devices.

Another object of the present invention is to provide a credit card with driver's license which is able to provide information about the user while also allowing the user to access a line of credit.

A further object of the present invention is to provide a credit card with driver's license which is able to hamper the ability of persons to produce fake identification cards.

A yet further object of the present invention is to provide a credit card with driver's license which is able to minimize the amount of credit card fraud by providing a large amount of information regarding the user of the credit card.

A still further object of the present invention is to provide a credit card with driver's license including a direct link to the motor vehicle bureau thereby allowing vehicle registration and driver's license fees to be directly billed to individuals.

A further object of the present invention is to provide a credit card with driver's license able to allow immediate payment of tickets issued by police thereby minimizing the inconvenience of paying for tickets through the mail.

A further object of the present invention is to provide a credit card with driver's license wherein information regarding driving record of the owner and the current status of vehicle registration and license renewal can be included on monthly billing statements for the credit card.

A still further object of the present invention is to provide a credit card with driver's license able to be used as a form of identification throughout the world due to ease of authentication and in any automatic teller machine or point-of-sale credit card terminal.

A yet further object of the present invention is to provide a credit card with driver's license that is simple and easy to use.

An even further object of the present invention is to provide a credit card with driver's license that is economical in cost to manufacture.

Additional objects of the present invention will appear as the description proceeds.

A credit card with driver's license for providing credit to an individual, information regarding the individual and proof of registration to operate a motor vehicle on a single form of identification is disclosed by the present invention. The credit card with driver's license includes a semi rigid thin piece of material having a face side, a photograph of the individual positioned on the face side, additional identifying information positioned on the face side and a magnetic strip storing information providing access to credit of the individual and personal information regarding the individual upon reading of said magnetic strip by a credit card terminal. The credit card with driver's license is registered with a department of motor vehicles in a state in which the owner resides and credit is provided by either an independent financial institution or the state government issuing the driver's license. The additional information includes at least one of a date of birth, height, weight, hair color, eye color, sex and an address of the owner printed on said face side. The credit card with driver's license may be laminated to provide additional protection against altering information thereon. A strip is also positioned on a back side thereof within which the individual places a signature for purposes of authentication when accessing credit provided by said credit card with driver's license.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 4:
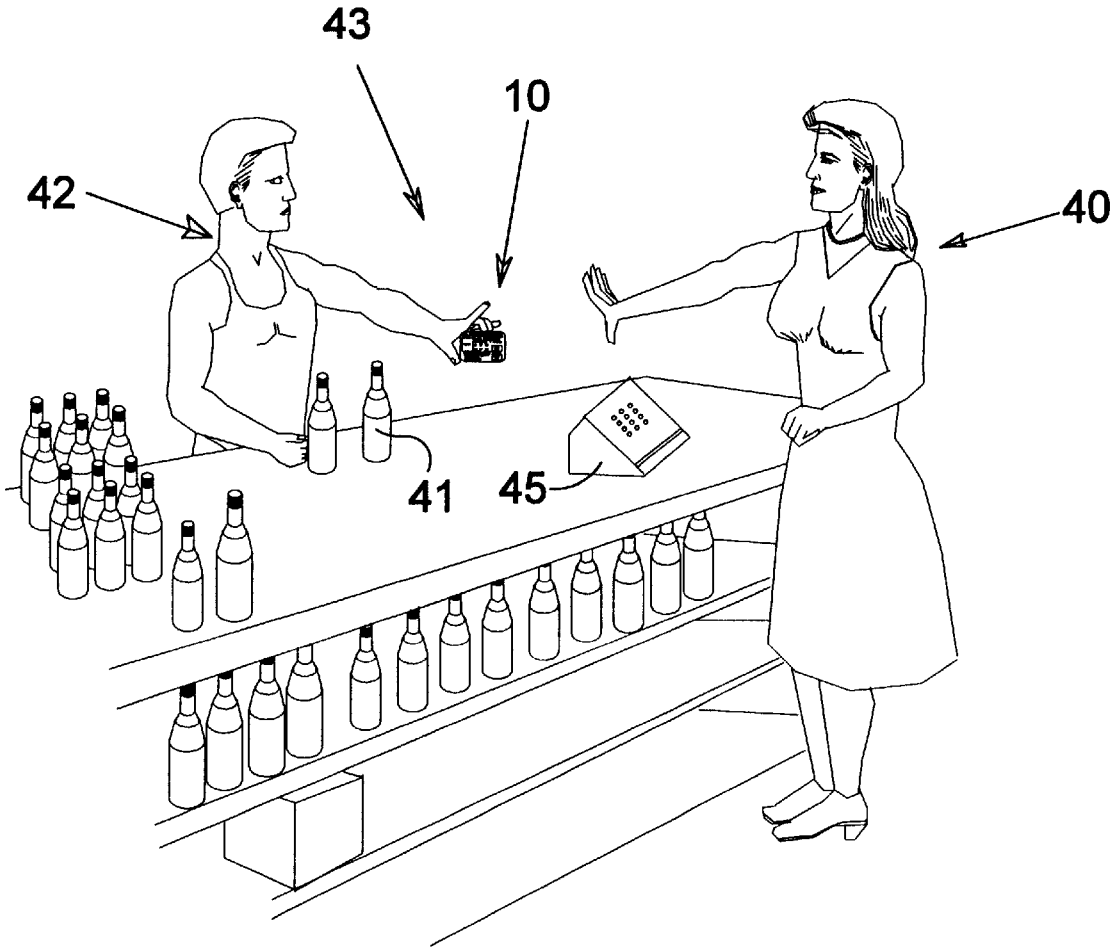
Figure 5:
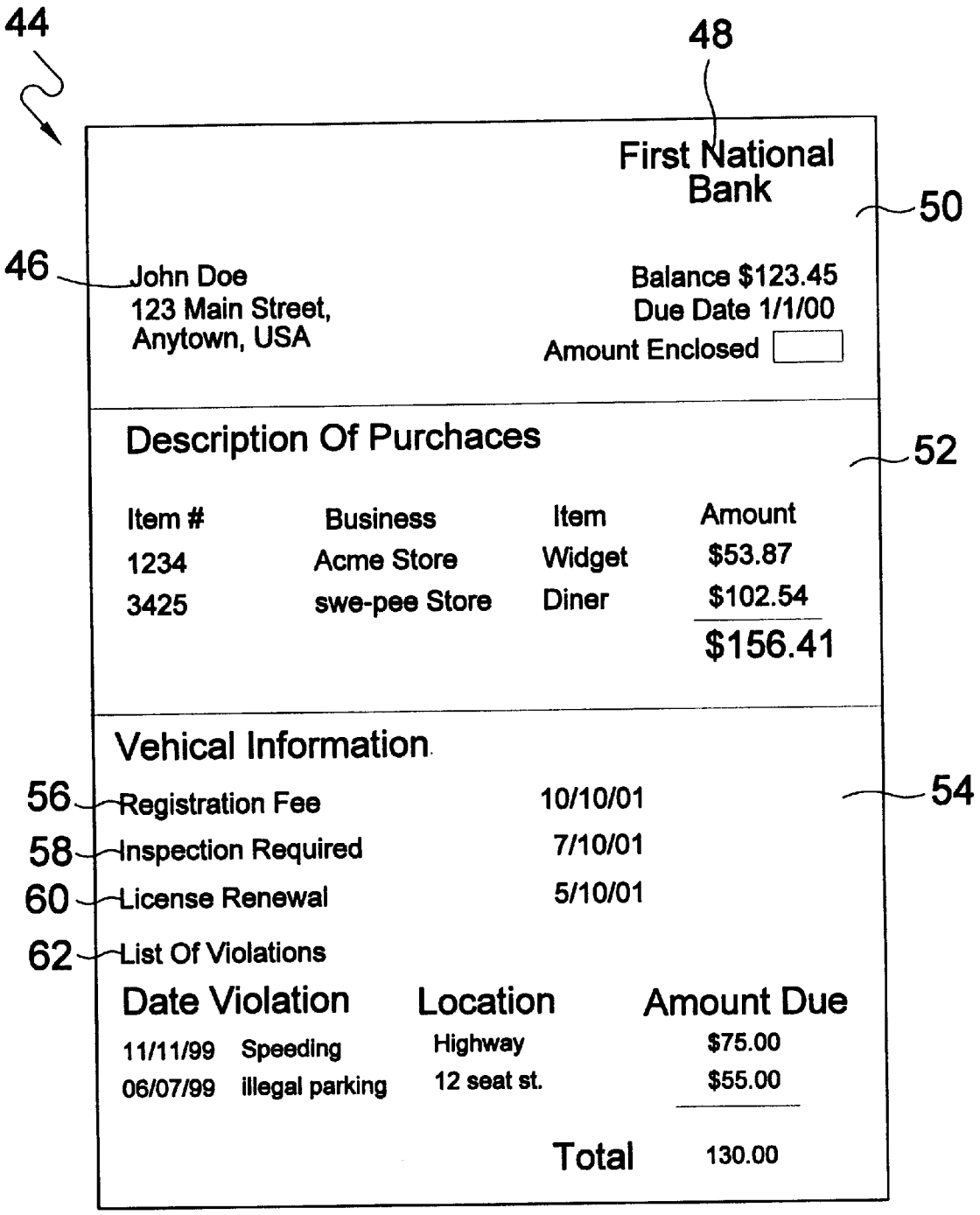

FIG. 4 is perspective view of an unauthorized underage person attempting to use the credit card with driver's license or identification of the present invention to buy alcohol whereby the authenticity of the card is easily checked by a point of sale credit card terminal; and FIG. 5 is a front view of a billing statement for the credit card with driver's license or identification of the present invention.

DESCRIPTION OF THE REFERENCED NUMERALS

Turning now descriptively to the drawings, in which similar reference characters denote similar elements throughout the several views, the Figures illustrate the credit card with driver's license or identification of the present invention. With regard to the reference numerals used, the following numbering is used throughout the various drawing figures.

10 credit card with driver's license or identification of the present invention
11 front side of credit card with driver's license or identification
12 photograph of owner of credit card with driver's license
14 address of owner
16 personal information concerning owner
18 state issuing credit card with driver's license
20 identification of credit card issuer
22 social security number of card owner
23 credit card number
24 expiration date of driver's license
25 expiration date of credit card
26 back side of credit card with driver's license
28 signature of owner
30 magnetic strip including credit card information and driver information
32 owner of card
34 vehicle of owner
36 police officer
38 police vehicle
40 unauthorized minor
41 bottle of alcohol
42 person checking validity of credit card with driver's license
43 tavern
44 billing statement
45 point-of-sale credit card terminal
46 information on card owner
48 information on issuing bank
50 account information
52 description of credit card activity
54 card owner's vehicle information
56 registration information
58 inspection information
60 license renewal information
62 list of traffic violations

DETAILED DESCRIPTION OF THE PREFERRED EMBODIMENT

Turning now descriptively to the drawings, in which similar reference characters denote similar elements throughout the several views, FIGS. 1 through 5 illustrate the credit card with driver's license or identification of the present invention indicated generally by the numeral 10.

Figure 1:
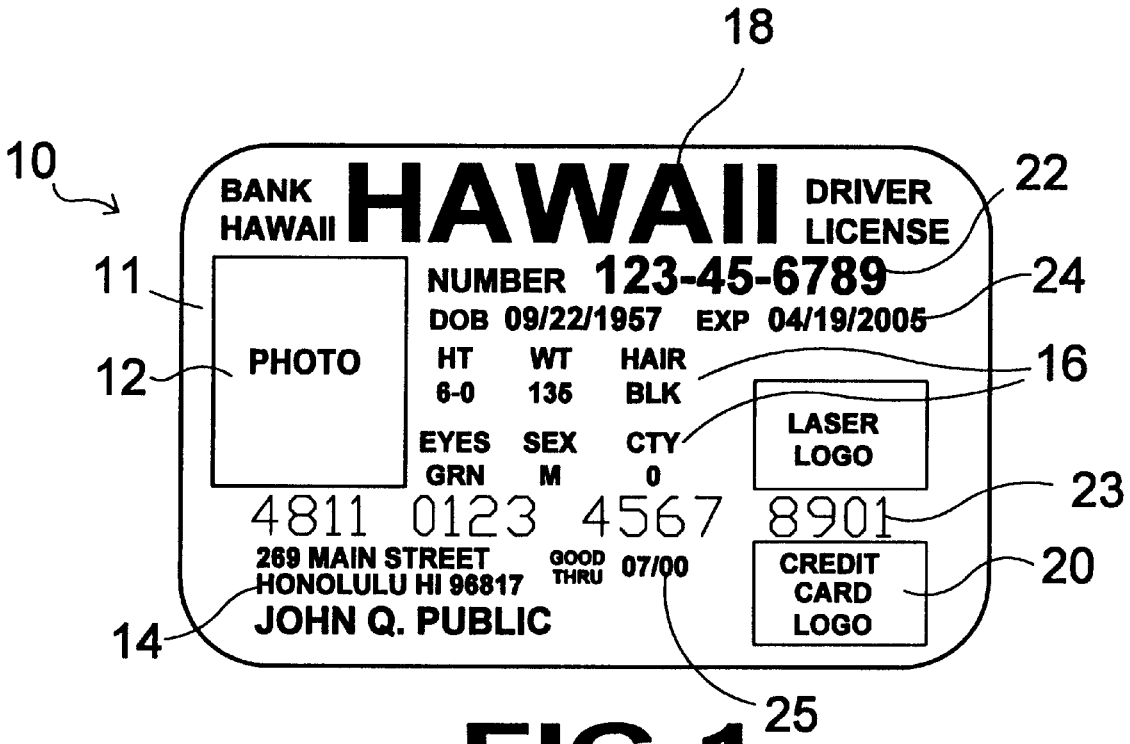
FIG. 1 is a front view of the credit card with driver's license or identification of the present invention.
Figure 2:
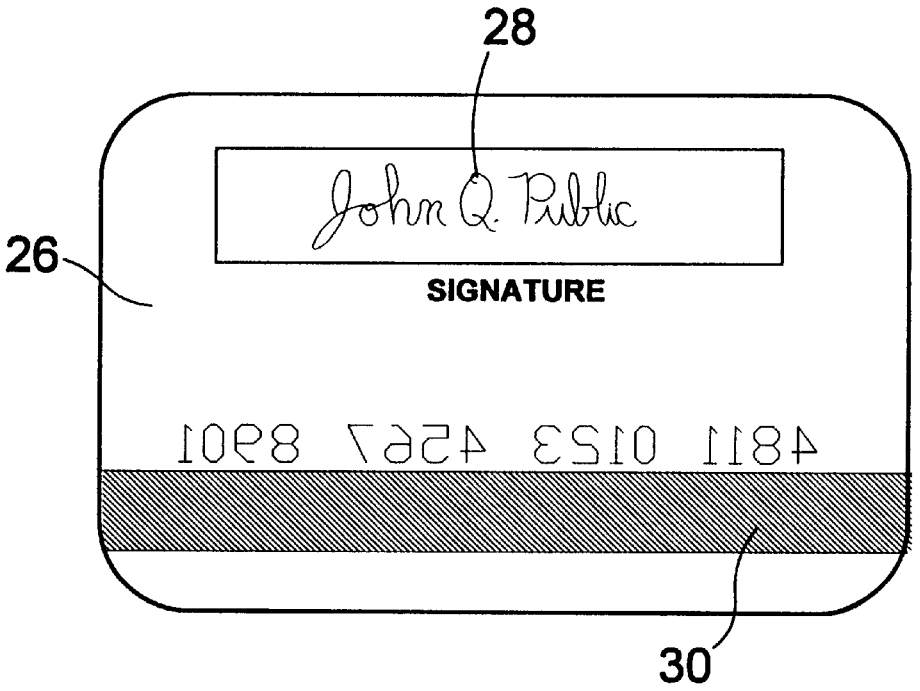
FIG. 2 is a back view of the tool box positioned in the work area on the credit card with driver's license or identification of the present invention.

The credit card with driver's license 10 is shown in FIGS. 1 and 2. A Front side 11 of the credit card with driver's license 10 includes numerous pieces of information. A photograph 12 of the owner of the credit card with driver's license 10 is positioned on the front side 11 to provide a visual means for identification of the owner of the credit card with driver's license 10. The home address 14 of the owner is also positioned on the front side of the credit card with driver's license 10 along with identifying physical information 16 and the name of the state 18 issuing the credit card with driver's license 10. A credit card logo 20 indicating the company providing the credit associated with the credit card with driver's license 10 may also positioned on the front side 11 along with the social security number 22 of the owner and the expiration date 24 of the driver's license portion of the credit card with driver's license 10. Credit card information including the credit card number 23 and the expiration date 25 of the credit card are also provided on the front side 11 of the credit card with driver's license 10. The credit card with driver's license 10 may be laminated to protect the card and the photograph thereon. Furthermore, the expiration of the credit card and driver's license may be caused to coincide thereby requiring only a single expiration date to be printed on the face side 11 and minimizing the amount of duplication of information provided on the credit card with driver's license 10.

A back side 26 of the credit card with driver's license or identification 10 is illustrated in FIG. 2. As can be seen from this figure, the back side 26 includes a signature space 28 within which the owner will sign to provide an authentic representation of the owners signature for reference when using the credit card with driver's license 10 to charge goods and services. A magnetic strip 30 to be read by a point-of-service credit card machine when making a purchase, checking the authenticity of the credit card with driver's license 10 or even withdrawing money from an automatic teller machine is also provided on the back side 26. The magnetic strip 30 includes information stored thereon for providing the desired information or access to the credit and bank accounts of the owner. The credit card number 23 is preferably raised on the front side 11 and thereby forms indentations on the back side 26 of the credit card with driver's license 10 which are visible thereon.

Figure 3:
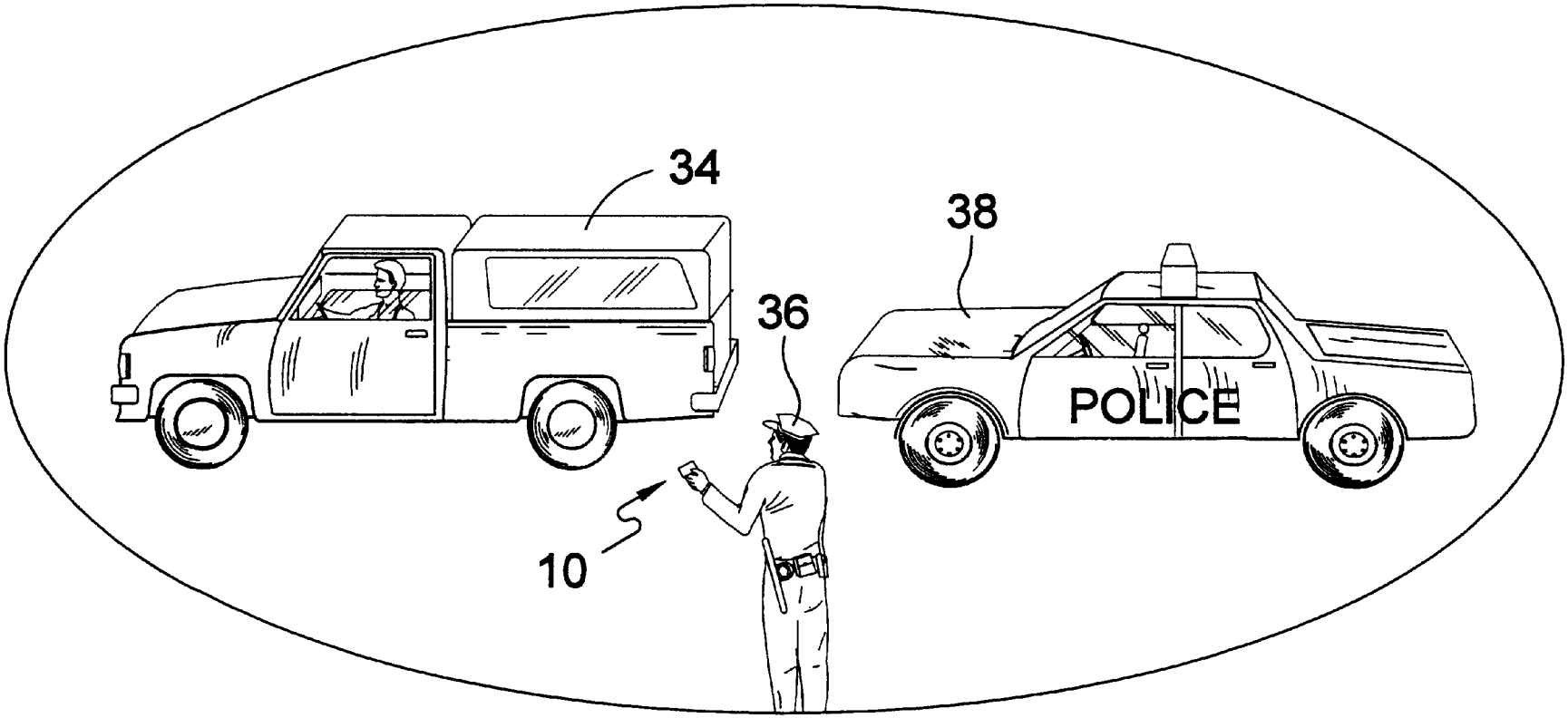
FIG. 3 is perspective view of a police officer using the credit card with driver's license or identification of the present invention to immediately charge a ticket for a moving violation to a driver.

Use of the credit card with driver's license 10 as identification when pulled over by a police office to identify the driver/owner and possibly to immediately charge the fee for a traffic ticket is shown in FIG. 3. In this figure, a vehicle 34 is illustrated stopped by a police officer 36 having a police vehicle 38. The police officer 36 has taken the credit card with driver's license 10 from the owner of the vehicle 34 and can process it in the police vehicle 38. The credit card with driver's license 10 is used by the police officer 36 to check the identification and record of the owner. The credit card with driver's license 10 includes information that the officer 36 can enter into a computer within the police vehicle 38 to identify the owner or driver and to check the number of traffic and legal violations the owner has outstanding. The magnetic strip 30 may include information stored thereon which will allow the officer 36 access to the desired information on the owner by simply running the magnetic strip through a reading device in the vehicle 38 as is done with any credit card transaction. The credit card with driver's license 10 can also be used to determine if any outstanding warrants have been issued for the owner. If the police office 36 is able to determine that the owner has outstanding warrants, the owner may be taken into custody immediately. Should the owner admit to the violation for which the vehicle was pulled over, the police officer 36 can charge the amount of the ticket to the credit card with driver's license 10 immediately and avoid the necessity of sending in a check for payment, the driver or owner would only have to sign a statement admitting to the infraction. For such instances the police vehicle 38 would have a credit card point-of-sale terminal located therein through which the credit transaction could be processed.

Use of the credit card with driver's license 10 as identification for proof of age is illustrated in FIG. 4. This figure illustrates a person 42 attempting to purchase alcohol 41 from a bartender 40 in a tavern 43. The credit card with driver's license 10 provides information concerning the age of the person 42 and along with the picture on the face side of the credit card with driver's license 10 can be used to check whether the person 42 is underage for purchasing alcoholic beverages. The credit card with driver's license 10 can also be used in the same manner with other items not available to persons under a certain age such as cigarettes or passes to restricted movies. A point of sale terminal 45 is provided in the tavern 43 for use in charging any purchase with the credit card with driver's license 10 upon determining the person 42 is of legal age. The point-of-sale terminal 45 may also be adapted to provide information concerning the owner which is stored in database records of the department of motor vehicles regarding the true age of the person 42. Thus, the ability of the person 42 to forge incorrect information in the credit card with driver's license 10 is minimized.

A view of an exemplary form of statement 44 to be received each month by each owner of the credit card with driver's license 10 is shown in FIG. 5. This statement 44 not only includes information on the credit purchases of the owner but also information regarding the driving record of the owner and information on the owner's vehicle. The name and address 46 of the owner are positioned at a top end of the statement 44. Also positioned on a top side of the statement 44 is the name of the bank 48 underwriting the credit of the owner and account information 50 such as the balance due, date payment is due and a space to insert the amount of payment enclosed to the bank.

A second section of the statement 44 is reserved for information regarding the account activity 52. In this section information regarding all credits and purchases are listed and totaled to provide the owner with an itemized list of the credit card account. For each purchase, an item number, store at which the purchase was made, description of the item purchased and the price are provided. At the end of the list, a total amount due is provided for the owners reference.

A third section of the statement 44 provides information regarding the driving record of the owner, vehicle information and license information 54. A listing of the due date for re-registering the vehicle 56 is provided along with information regarding when an inspection on the vehicle is due 58 and the date the license of the owner needs to be renewed 60. Additionally, information 62 regarding outstanding traffic violations is provided along with the location of the infraction and the amount due on the infraction.

The owner thus receives a constant reminder regarding information concerning the license and any vehicle registered to the owner. This will minimize the possibility of the owner receiving a ticket for an expired registration or inspection sticker as a constant reminder of the due dates will be received monthly. When the due dates approach, they can be highlighted to thereby attract the attention of the owner providing a reminder to take care of payment of the fees due, processing of the proper forms and performance of the required obligations such as having the vehicle inspected.

Furthermore, the combination of a credit card and driver's license eliminates an additional item which people need to carry. The trouble of paying traffic tickets is also eliminated should the driver admit responsibility for the infraction. The owner is further provided ample warning and notification of due dates for payment of different fees and inspections on a monthly statement whereby the credit card with driver's license 10 may also be used to pay those fees directly without sending of a check to the department of motor vehicles. The credit card with driver's license 10 can also be used as an automatic teller machine card to withdraw money from a bank's automatic teller machines.

The operation of the credit card with driver's license or identification 10 will now be described with reference to the figures. In operation, the credit card with driver's license or identification 10 contains information regarding the owner of the card and information to access credit for the owner. The credit card with driver's license 10 can be used in any establishment to purchase products or as identification to purchase certain products such as alcohol and tobacco products when desired. Thus, the credit card with driver's license 10 may be used to deny a person without the requisite proof of age or who is underage the right to purchase such products.

The credit card with driver's license 10 is also used by law enforcement personnel to obtain information on a person or during a traffic stop to identify the driver of a vehicle. A person who is stopped for and admits to an infraction can also pay the fine immediately with the credit card with driver's license 10.

From the above description it can be seen that the credit card with driver's license of the present invention is able to overcome the shortcomings of prior art devices by providing a credit card with driver's license which is able to provide information about the user while also allowing the user to access a line of credit and hampering the ability of persons to produce fake identification cards thereby minimizing the amount of credit card fraud by providing a large amount of information regarding the user of the credit card. The credit card with driver's license includes a direct link to the department of motor vehicles thereby allowing vehicle registration and driver's license fees to be directly billed to individuals, allow immediate payment of tickets issued by police thereby minimizing the inconvenience of paying for tickets through the mail and provide information regarding driving record and providing current status of vehicle registration and license renewal on monthly billing statements for the credit card. The credit card with driver's license is also able to be used as a form of identification throughout the world due to ease of authentication in any automatic teller machine or point-of-sale credit card terminal. Furthermore, the credit card with driver's license of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A credit card incorporating a driver's license registered with a state department of motor vehicles and for providing both automobile related and non related usage credit to an individual, information regarding the individual and proof of registration to operate a motor vehicle on a single form of identification, said credit card with driver's license comprising:

a) a semi rigid thin piece of material having a face side showing the name of a private financial institution providing credit obtained by the use of said card and the credit card number issued by said private financial institution;

b) a photograph of the individual positioned on said face side;

c) additional identifying information regarding the individual positioned on said face side; and d) a magnetic strip storing information providing access to credit of the individual and personal information regarding the individual upon reading of said magnetic strip by a credit card terminal, said information including data required by a point-of-service credit card machine when making an automobile related and non related usage purchase, an automatic teller machine for withdrawing cash, and department of motor vehicle data for use by law enforcement personnel.

2. The credit card with driver's license as recited in claim 1, wherein said additional information includes at least one of a date of birth, height, weight, hair color, eye color and sex of the individual.

3. The credit card with driver's license as recited in claim 2, further comprising an address of the individual printed on said face side.

4. The credit card with driver's license as recited in claim 1, wherein said credit card with driver's license is laminated to provide additional protection for said credit card with driver's license and minimize the possibility of altering information on said credit card with driver's license.

5. The credit card with driver's license as recited in claim 1, further comprising a strip positioned on a back side of said credit card with driver's license within which the individual places a signature for purposes of authentication when accessing credit provided by said credit card with driver's license.

6. The credit card with driver's license as recited in claim 1, wherein said magnetic strip includes information stored thereon for providing access to information retained by the financial institution issuing credit to persons with a reading device for said magnetic strip.

* * * * *